US007306474B1

(12) United States Patent
Brown

(10) Patent No.: US 7,306,474 B1
(45) Date of Patent: Dec. 11, 2007

(54) ELECTRICAL CONNECTOR WITH SCOOP PROOF DOME

(75) Inventor: Cecil Brown, Detroit, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/582,202

(22) Filed: Oct. 16, 2006

(51) Int. Cl.
*H01R 13/627* (2006.01)

(52) U.S. Cl. ..... 439/352

(58) Field of Classification Search ..... 439/352, 439/188, 489, 351, 353
See application file for complete search history.

(56) References Cited

U.S. PATENT DOCUMENTS

| | | | | |
|---|---|---|---|---|
| 5,275,575 | A * | 1/1994 | Cahaly et al. | 439/188 |
| 5,613,865 | A | 3/1997 | Dullin et al. | 439/188 |
| 5,746,618 | A | 5/1998 | Gauker | 439/352 |
| 5,924,885 | A | 7/1999 | Pacher | 439/352 |
| 5,993,230 | A | 11/1999 | Gauker et al. | 439/188 |
| 6,152,775 | A | 11/2000 | Pavlovic | 439/620 |
| 6,276,953 | B1 | 8/2001 | Gauker et al. | 439/352 |
| 6,402,540 | B1 | 6/2002 | Kuhmel et al. | 439/378 |
| 6,419,510 | B2 | 7/2002 | Shiraki et al. | 439/188 |
| 6,530,799 | B2 | 3/2003 | Regnier et al. | 439/352 |
| 6,544,060 | B2 * | 4/2003 | Wakui et al. | 439/188 |
| 6,699,059 | B2 * | 3/2004 | Nagamine et al. | 439/352 |
| 6,726,495 | B2 | 4/2004 | Hirschmann | 439/188 |
| 6,739,913 | B2 * | 5/2004 | Hayashi | 439/620.05 |
| 6,893,277 | B2 | 5/2005 | Parrish et al. | 439/188 |
| 6,910,902 | B2 * | 6/2005 | Osada | 439/188 |
| 6,945,801 | B2 * | 9/2005 | Brown | 439/188 |
| 6,997,750 | B2 | 2/2006 | Johannes et al. | 439/620 |
| 7,004,778 | B2 | 2/2006 | Barker et al. | 439/352 |
| 2006/0079118 | A1 | 4/2006 | Holweg | 439/489 |

FOREIGN PATENT DOCUMENTS

| | | |
|---|---|---|
| DE | 10032234 A1 | 1/2002 |
| DE | 10151956 A1 | 7/2002 |

* cited by examiner

*Primary Examiner*—Tulsidas C. Patel
*Assistant Examiner*—Vladimir Imas
(74) *Attorney, Agent, or Firm*—Harrington & Smith, PC

(57) ABSTRACT

A socket electrical connector adapted to receive a portion of a mating plug electrical connector. The socket electrical connector includes a housing, at least two electrical contact terminals, and a contact shorting member. The housing includes a first housing member and a second housing member. The second housing member is located in the first housing member and forms a scoop proof dome having a height extending above a top side of the first hosing member. The second housing member forms at least one receiving area for receiving the portion of the mating plug electrical connector. The electrical contact terminals are connected to the first housing member and extend into the at least one receiving area of the second housing member. The contact shorting member is mounted on the second housing member and contacts the electrical contacts.

21 Claims, 7 Drawing Sheets

ELECTRICAL CONNECTOR WITH SCOOP PROOF DOME

BACKGROUND OF THE INVENTION

1. Field of the Invention

The invention relates to an electrical connector and, more particularly, to a scoop proof electrical connector.

2. Brief Description of Prior Developments

U.S. Pat. No. 6,726,495, which is hereby incorporated by reference in its entirety, discloses a squib, scoop proof electrical connector. The connector is used for an air bag system in a vehicle, and the scoop proof feature prevents scoop-proof insertion of the plug connector into the socket connector. U.S. Pat. No. 6,997,750 discloses a squib electrical connector with a ferrite tube surrounding portions of contacts. U.S. Pat. No. 5,993,230 discloses a co-axial squib electrical connector with a ferrite block surrounding portions of electrical wires.

A problem exists with conventional squib electrical connectors used as vehicle air bag connectors in that the height size of the connectors are limited due to the limited size of the area they are used in (vehicle space limitations), and the height of ferrite tubes at contact areas of plug connectors is desired to be larger for better filtering or attenuating. These two diametrically opposite factors have prevented a small size squib air bag connector from having adequate ferrite filtering at its contacts. There is a desire for a squib air bag electrical connector with an increased height ferrite member(s) at its contacts.

SUMMARY OF THE INVENTION

In accordance with one aspect of the invention, a socket electrical connector is provided which is adapted to receive a portion of a mating plug electrical connector. The socket electrical connector includes a housing, at least two electrical contact terminals, and a contact shorting member. The housing includes a first housing member and a second housing member. The second housing member is located in the first housing member and forms a scoop proof dome having a height extending above a top side of the first housing member. The second housing member forms at least one receiving area for receiving the portion of the mating plug electrical connector. The electrical contact terminals are connected to the first housing member and extend into the at least one receiving area of the second housing member. The contact shorting member is mounted on the second housing member and contacts the electrical contacts.

In accordance with another aspect of the invention, a squib electrical connector assembly is provided comprising a plug electrical connector and a socket electrical connector connected to the plug electrical connector. The plug electrical connector comprises a plug housing, female electrical contacts and at least one ferrite tube. The socket electrical connector comprises a socket housing, male electrical contacts and a contact shorting member. The socket housing comprises a first housing member and a second housing member. The second housing member is located in the first housing member and forms a scoop proof dome having a height extending above a top side of the first housing member. The second housing member forms at least one receiving area having a portion of the plug housing mounted therein. The portion of the plug housing comprises an extended height plug portion to accommodate a height of the scoop proof dome. The at least one ferrite tube comprises an extended height which extends above a top plane of the scoop proof dome at least about 30 percent of the height of the ferrite tube.

In accordance with another aspect of the invention, a method of assembling a squib electrical connector is provided comprising providing a first housing member; connecting an electrical contact shorting member to a second housing member, wherein the second housing member comprises an elevated height scoop proof dome portion; connecting electrical male contact terminals to the first housing member; inserting the second housing member into the first housing member wherein the elevated height scoop proof dome portion extends above a top side of the first housing member; and electrically connecting the male contact terminals to each other by the electrical contact shorting member.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
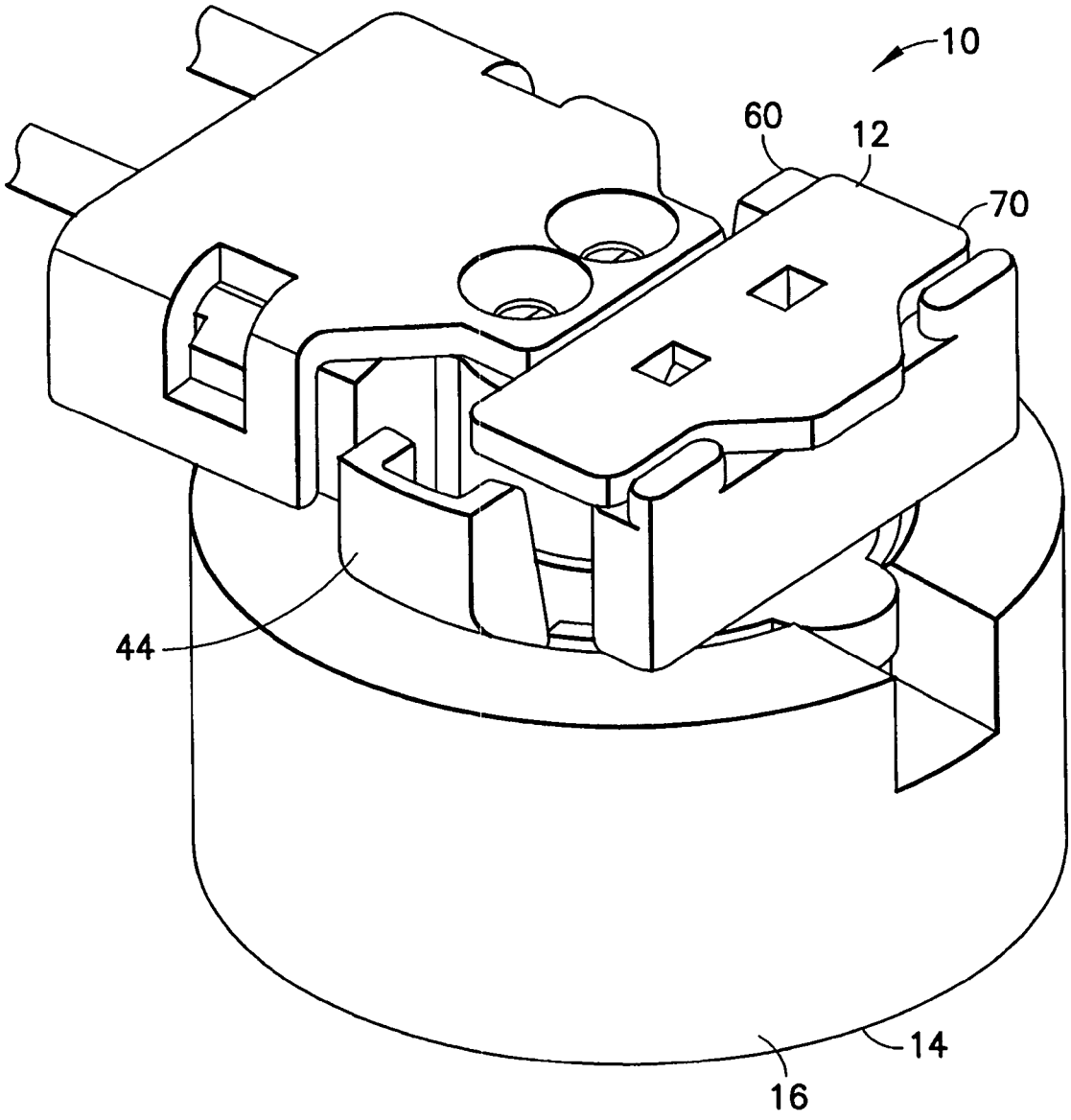
FIG. 1 is a perspective view of a squib electrical connector assembly incorporating features of the invention.

Referring to FIG. 1, there is shown a perspective view of a squib electrical connector assembly 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

Figure 2:
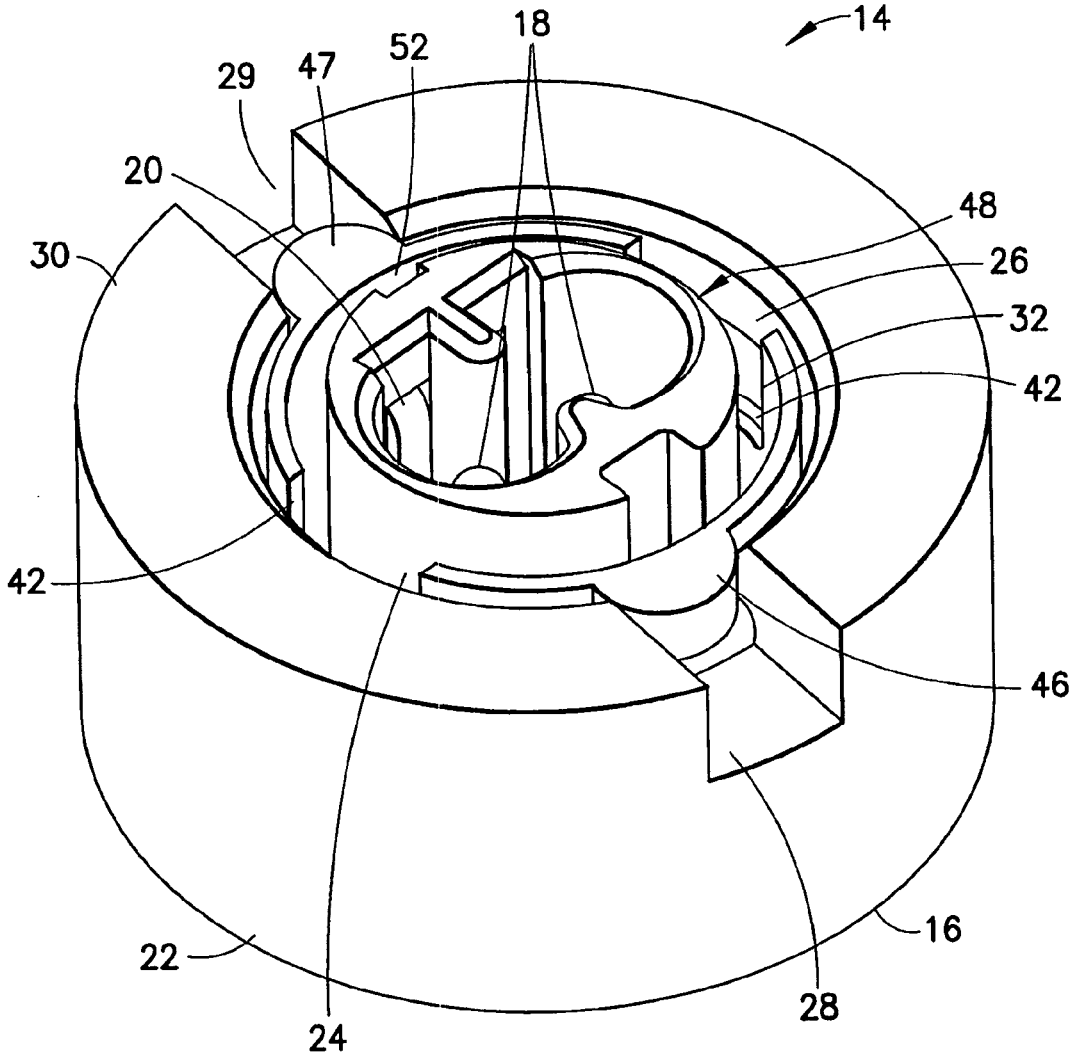
FIG. 2 is a perspective view of the socket electrical connector of the assembly shown in FIG. 1.
Figure 3:
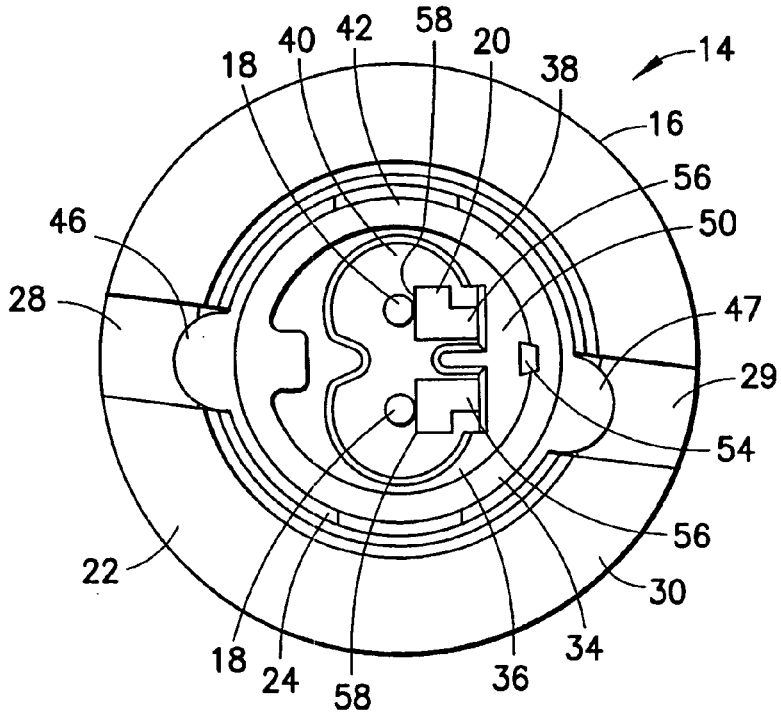
FIG. 3 is a plan top view of the socket electrical connector shown in FIG. 2.
Figure 4:
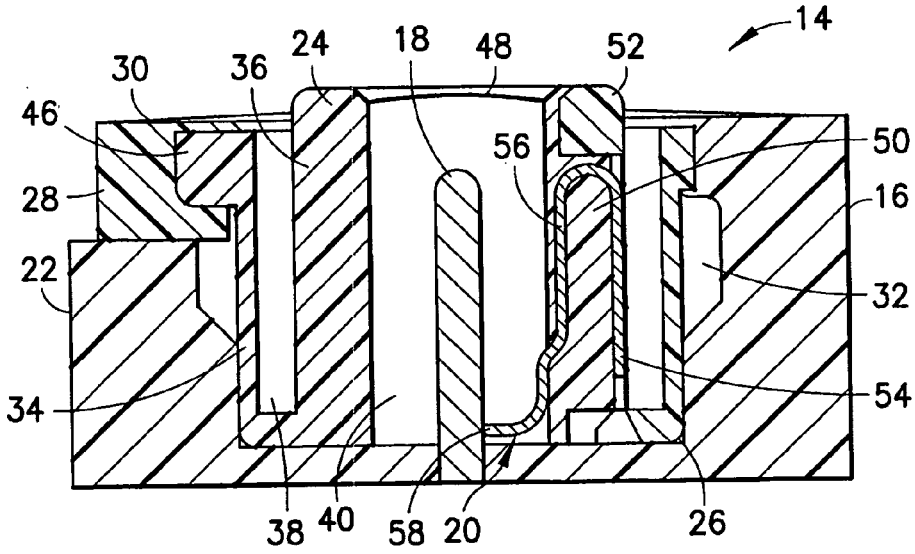
FIG. 4 is a cross sectional view of the socket electrical connector shown in FIGS. 2 and 3.

The assembly 10 generally comprises a plug electrical connector 12 and a socket electrical connector 14. Referring also to FIGS. 2-4, the socket electrical connector 14 generally comprises a socket housing 16, male electrical contacts or terminals 18 and a contact shorting member 20. The socket housing 16 generally comprises a first housing member 22 and a second housing member 24. In an alternate embodiment, the socket housing 16 could be a one-piece member, or could comprise more than two housing members. The first housing member 22 comprises a receiving area 26 and keying slots 28, 29 in its top side 30. The male electrical contacts 18 are mounted in the first housing member 22 and extend upward from the base of the first housing member into the receiving area 26. The first housing member 22 includes a latch receiving annular recess 32 in its side wall at the receiving area 26. In alternate embodiments, more than one latch receiving recess could be provided, and any suitable shape could be provided.

The second housing member 24 is mounted in the receiving area 26 of the first housing member 22. The second housing member 24 generally comprises two generally annular wall sections 34, 36 connected to each other by a base section. The wall sections 34, 36 for an inner receiving area 38 and an outer receiving area 40. The outer wall section 34 comprises two latch slots 42 to allow latches 44 (see FIG. 1) of the plug connector 12 to latch into the recess 32. The outer wall section 34 also comprises outwardly projecting, cantilevered key sections 46, 47. The key sections 46, 47 are received in the keying slots 28, 29 of the first housing member 22 to properly orientate the second housing member 24 relative to the first housing member 22.

The outer receiving area 40 has a general annular shape. The inner receiving area 38 has a general hour-glass type of shape or "8" type of shape. The inner wall section 36 has an elevated height which forms a scoop proof dome 48 that extends above the top side 30 of the first housing member 22. The inner wall section 36 also comprises a shorting member retainer section 50 having the contact shorting member 20 mounted thereon. The shorting member 20 extends through the shorting member retainer section 50 between an inner side of the inner wall section 36 and an outer side of the inner wall section 36. The inner wall section 36 also comprises a ramp section 52 above the shorting member 20 adapted to move a portion of the mating plug electrical connector 12 when the mating plug electrical connector is inserted into the socket connector 14.

Figure 5:
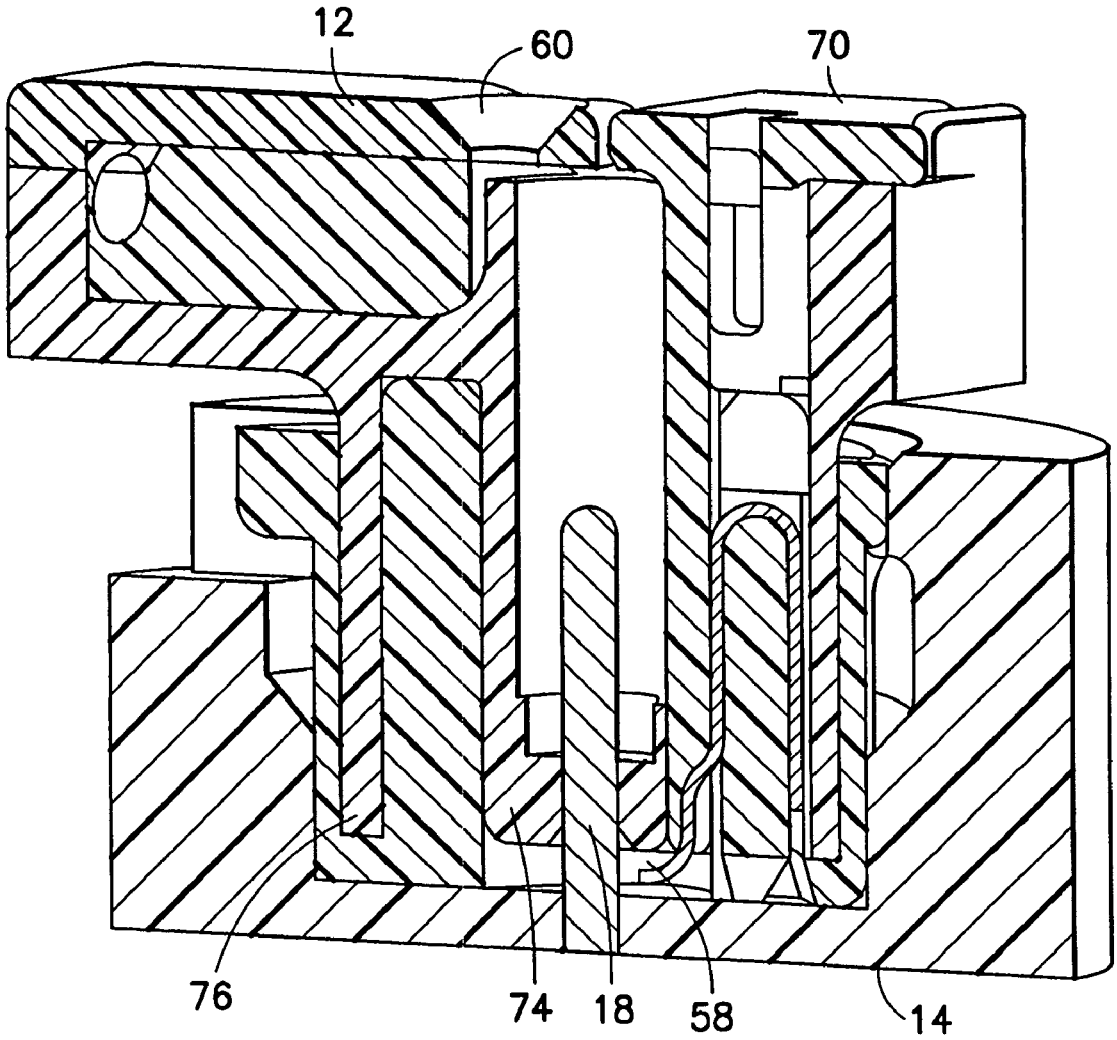
FIG. 5 is a cross sectional view of the assembly shown in FIG. 1, but without showing the female contacts and ferrite tubes merely for the sake of clarity.

The shorting member 20 comprises a formed sheet metal member with a first section 54 and two second sections 56. The second sections 56 have ends 58 which respectively contact the male contact terminals 18. The shorting member 20, thus, electrically connects the terminals 18 to each other. As seen in FIG. 5, the ends 58 are adapted to be resiliently deflected away from the male terminals 18 when the plug connector 12 is inserted into the socket connector 14.

Figure 6:
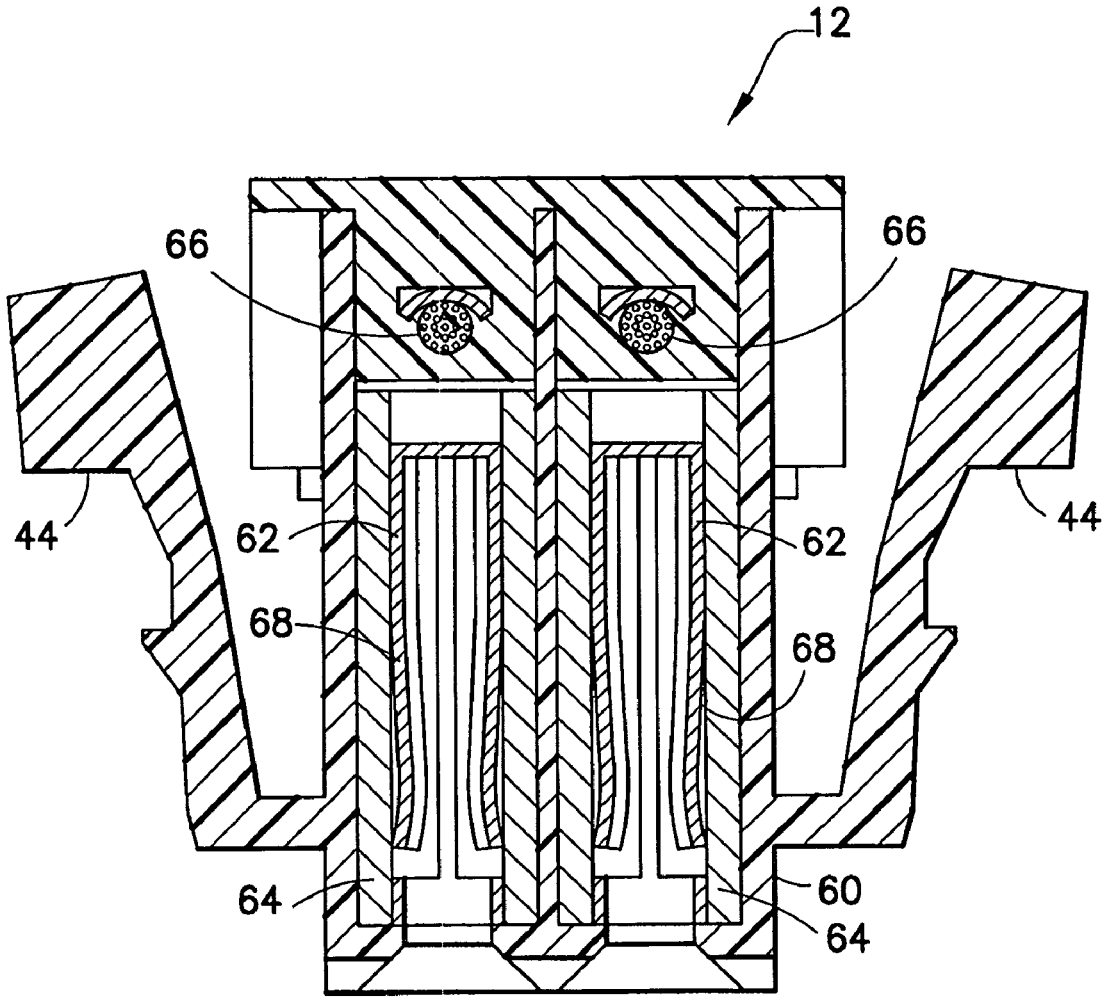
FIG. 6 is a cross sectional view of the plug electrical connector shown in FIGS. 1 and 5.

As seen in FIGS. 1, 5 and 6, the plug connector 12 generally comprises a plug housing 60, female electrical contacts 62, and ferrite members 64. In this embodiment the ferrite members 64 are tubes. However, in alternate embodiments any suitable shape(s) could be provided. The plug housing 60 is a right angle housing in this embodiment. However, in an alternate embodiment the plug housing could be a non-right angle connector housing. The housing 60 houses the two contacts 62 in a side-by-side configuration. The contacts 62 have rear ends connected to two respective wires 66. Front ends 68 of the contacts 62 form female receiving areas for receiving the male contacts 18. The front ends 68 are located inside the ferrite tubes 64. The plug housing 60 has portions 74, 76 which are adapted to be inserted into the receiving areas of the second housing member 24.

The plug connector 12 also comprises a connector position assurance (CPA) member 70. The CPA member 70 is shown in its down or locked position in FIGS. 1 and 5. The CPA member 70 is prevented from moving to its locked position unless the plug connector 12 is properly connected to the socket connector 14. More specifically, referring also to FIGS. 7-9, the plug housing 60 has a CPA latch 72. The latch 72 is part of the plug housing; not part of the CPA member 70. More specifically, latch 72 is part of the portion 76 and extends upward in a general cantilever fashion. The latch 72 includes a top stop surface 78 and a cam surface 80.

Figure 8:
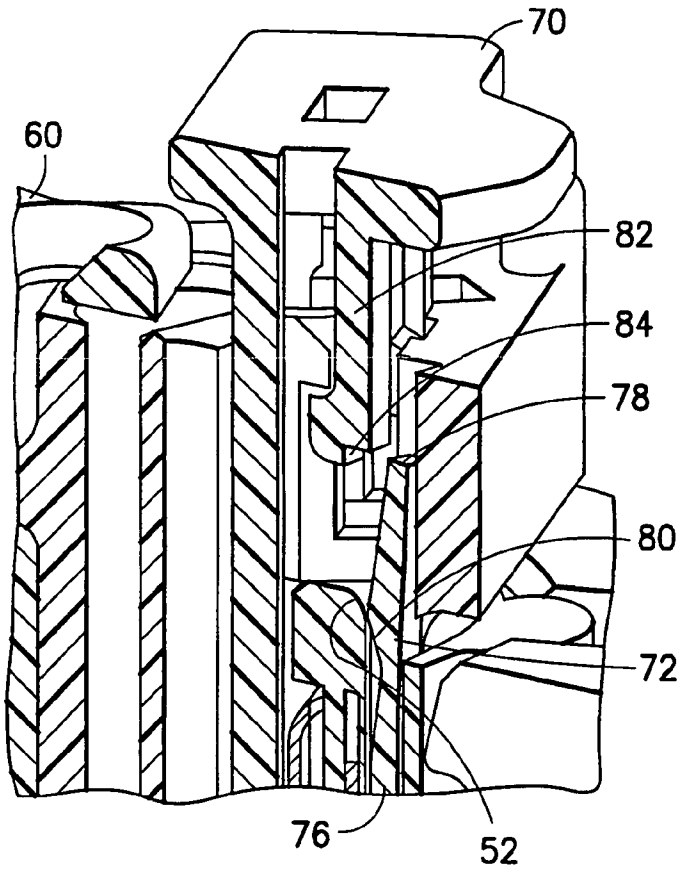
FIG. 8 is a partial cut-away view as in FIG. 7 after the plug connector is fully inserted into the socket connector, but before the CPA member is moved to a locked position.
Figure 7:
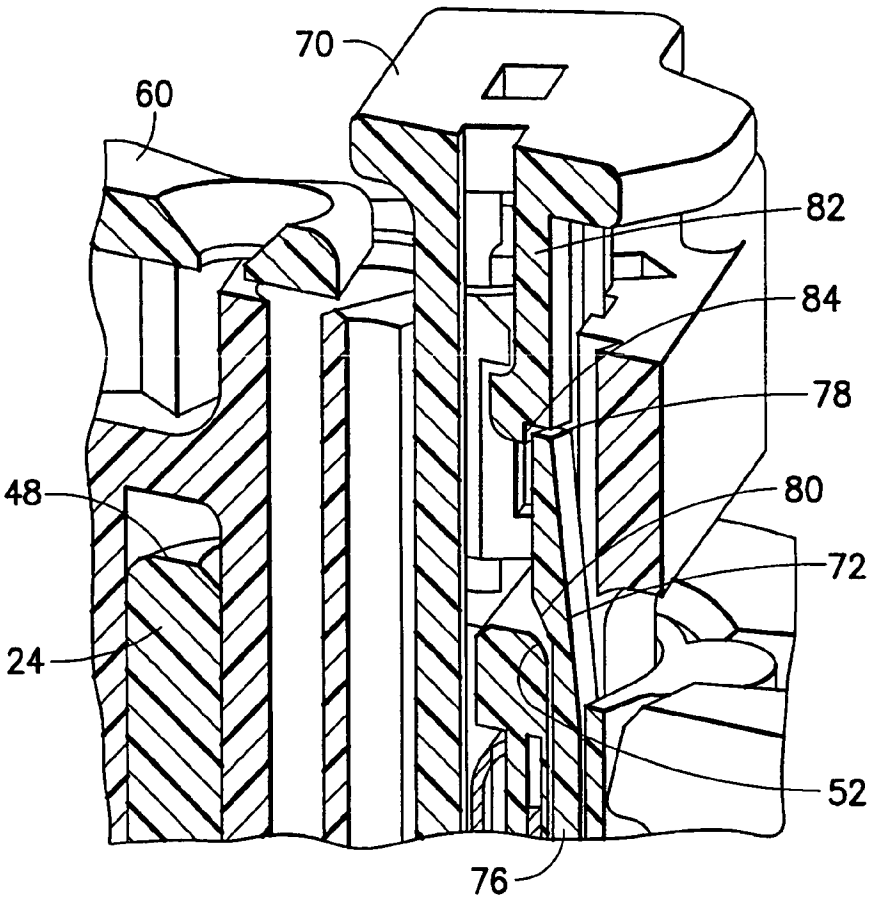
FIG. 7 is a partial cut-away view of the assembly shown in FIG. 1 before the plug connector is fully inserted into the socket connector.
Figure 9:
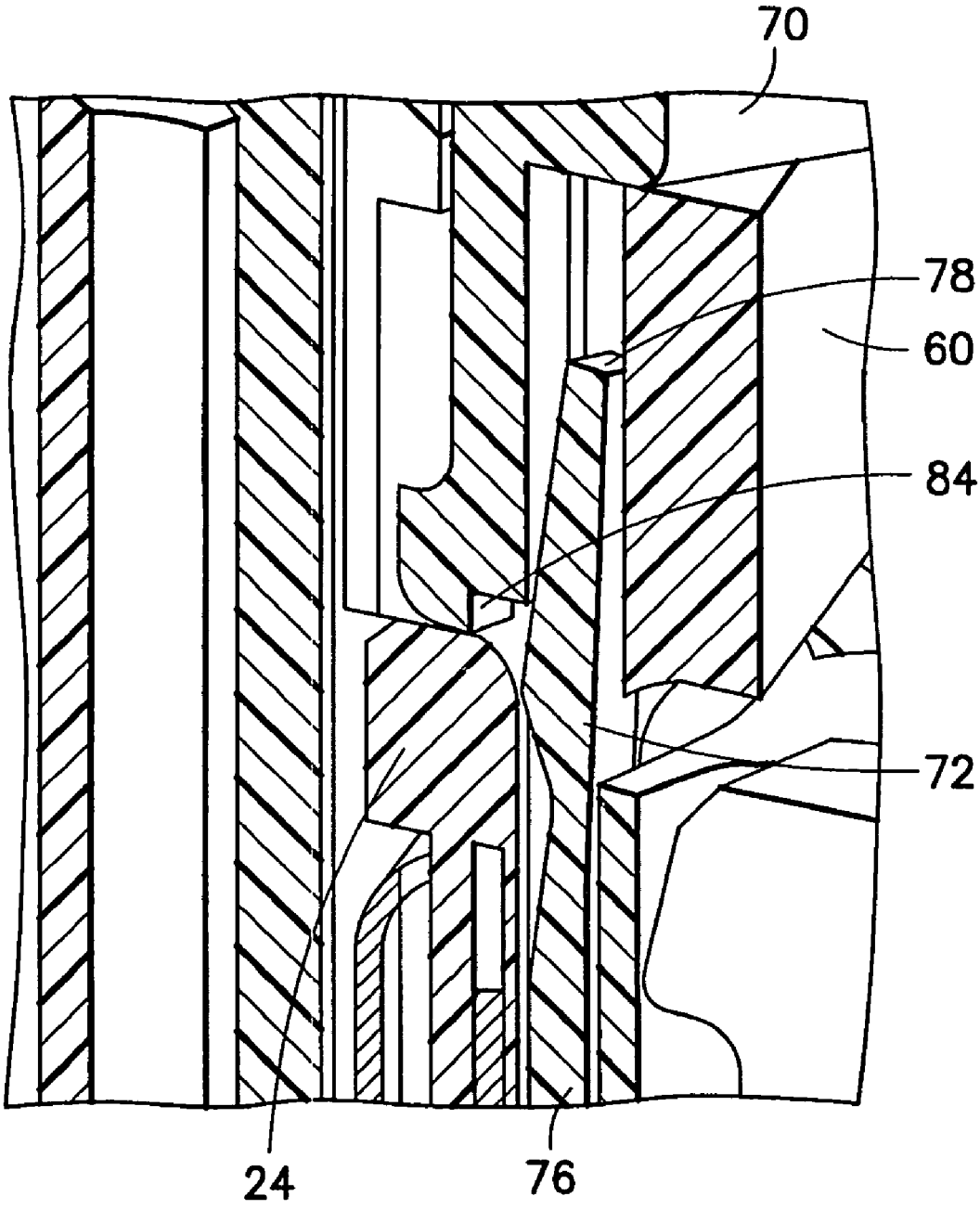
FIG. 9 is a partial cut-away view of as in FIG. 8 after the CPA member is moved to its locked position.

FIGS. 7-8 show the CPA member 70 in its up, unlocked position. The CPA member 70 includes a blocking section 82 with a stop surface 84. As seen in FIG. 7, before the plug connector 12 is fully inserted into the socket connector 14, the latch 70 is positioned in the path of the blocking section 82 such that the two stop surfaces 78, 84 engage each other and prevent the CPA member 70 from being moved to its locked position on the plug housing 60. As seen in FIG. 8, as the plug connector 12 is further inserted into the socket connector 14 to its fully inserted position, the ramp section 52 of the second housing member 24 contacts the cam surface 80, and resiliently cams the latch 72 outward. This moves the stop surface 78 out of the path of the stop surface 84. Thus, the scoop proof dome 48 has an engagement feature (the ramp section 52 of the shorting member retainer section 50) that moves the flexible arm (the CPA latch 72) of the plug connector 12. The CPA latch 72 is moved to allow the CPA member to latch. The user can then push the CPA member 70 downward as shown in FIG. 9 to its final locked position.

With the invention, the scoop proof dome 48 prevents the male contact pins 18 from being bent during connection of the connectors 12, 14 to each other. This is because of the extended height of the second housing member 24. The extended height insures that the plug connector 12 is substantially completely aligned with the center axis of the receiving area 38 before the plug connector 12 can make contact with the top ends of the pins 18. Thus, by preventing the pins 18 from becoming inadvertently bent, this helps to insure that the pins 18 properly connect with the contacts 62. In a preferred embodiment, at least one ferrite tube comprises an extended height which extends above a top plane of the scoop proof dome at least about 20 percent of the height of the ferrite tube, and preferably at least about 30 percent.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A socket electrical connector adapted to receive a portion of a mating plug electrical connector, the socket electrical connector comprising:

a housing comprising a first housing member and a second housing member, wherein the second housing member is located in the first housing member and forms a scoop proof dome having a height extending above a top side of the first hosing member, wherein the second housing member forms at least one receiving area for receiving the portion of the mating plug electrical connector;

at least two electrical contact terminals connected to the first housing member and extending into the at least one receiving area of the second housing member; and a contact shorting member mounted on the second housing member and contacting the electrical contacts, wherein the at least one receiving area comprises a first inner receiving area having the terminals therein, and a second outer receiving area at least partially separated from the first inner receiving area by a wall of the second housing, wherein the second outer receiving area at least partially surrounds the first inner receiving area.

2. A socket electrical connector as in claim 1 wherein the terminals comprise spaced, parallel male contact pins.

3. A socket electrical connector as in claim 1 wherein the second housing member comprises a shorting member retainer section having the contact shorting member mounted thereon, and wherein the shorting member extends through the shorting member retainer section between an inner side of the shorting member retainer section and an outer side of the shorting member retainer section.

4. A socket electrical connector adapted to receive a portion of a mating plug electrical connector, the socket electrical connector comprising:

a housing comprising a first housing member and a second housing member, wherein the second housing member is located in the first housing member and forms a scoop proof dome having a height extending above a top side of the first hosing member, wherein the second housing member forms at least one receiving area for receiving the portion of the mating plug electrical connector;

at least two electrical contact terminals connected to the first housing member and extending into the at least one receiving area of the second housing member; and a contact shorting member mounted on the second housing member and contacting the electrical contacts, wherein the second housing member comprises a shorting member retainer section having the contact shorting member mounted thereon, wherein the shorting member retainer section comprises a ramp section above the shorting member adapted to move a portion of the mating plug electrical connector when the mating plug electrical connector is inserted into the at least one receiving area.

5. A squib electrical connector assembly comprising:

a plug electrical connector comprising a plug housing, female electrical contacts and at least one ferrite tube, wherein the at least one ferrite tube surrounds a male pin receiving section of the female electrical contacts; and a socket electrical connector as in claim 1 connected to the plug electrical connector, wherein the plug housing comprises an extended height plug portion to accommodate a height of the scoop proof dome, and wherein the at least one ferrite tube comprises an extended height which extends above a top plane of the scoop proof dome at least about 20 percent of the height of the ferrite tube.

6. A squib electrical connector assembly as in claim 5 wherein the extended height of the at least one ferrite tube extends above the top plane of the scoop proof dome at least about 30 percent of the height of the ferrite tube.

7. A squib electrical connector assembly as in claim 5 wherein the plug electrical connector further comprises a connector position assurance (CPA) member movably connected to the plug housing, wherein the plug housing comprises a latch adapted to retain the CPA member at an unlocked position, and wherein the latch is adapted to be moved by a ramp portion of the second housing member when the plug housing is inserted into the at least one receiving area.

8. A squib electrical connector assembly as in claim 7 wherein the ramp portion of the second housing member comprises a top of the scoop proof dome.

9. A squib electrical connector assembly comprising:

a plug electrical connector comprising a plug housing, female electrical contacts and at least one ferrite tube, wherein the at least one ferrite tube surrounds a male pin receiving section of the female electrical contacts; and a socket electrical connector connected to the plug electrical connector, the socket electrical connector comprising a socket housing, male electrical contacts and a contact shorting member, wherein the socket housing comprises a first housing member and a second housing member, wherein the second housing member is located in the first housing member and forms a scoop proof dome having a height extending above a top side of the first housing member, wherein the second housing member forms at least one receiving area having a portion of the plug housing mounted therein, wherein the portion of the plug housing comprises an extended height plug portion to accommodate a height of the scoop proof dome, and wherein the at least one ferrite tube comprises an extended height which extends above a top plane of the scoop proof dome at least about 30 percent of the height of the ferrite tube.

10. A squib electrical connector assembly as in claim 9 wherein the extended height of the at least one ferrite tube extends above the top plane of the scoop proof dome at least about 30 percent of the height of the ferrite tube.

11. A squib electrical connector assembly as in claim 9 wherein the second housing member comprises a shorting member retainer section having the contact shorting member mounted thereon, and wherein the shorting member extends through the shorting member retainer section between an inner side of the shorting member retainer section and an outer side of the shorting member retainer section.

12. A squib electrical connector assembly as in claim 9 wherein the second housing member comprises a shorting member retainer section having the contact shorting member mounted thereon, wherein the shorting member retainer section comprises a ramp section above the shorting member adapted to move a portion of the plug electrical connector when the plug electrical connector is inserted into the at least one receiving area.

13. A squib electrical connector assembly as in claim 9 wherein the plug electrical connector further comprises a connector position assurance (CPA) member movably connected to the plug housing, wherein the plug housing comprises a latch adapted to retain the CPA member at an unlocked position, and wherein the latch is adapted to be moved by a ramp portion of the second housing member when the plug housing is inserted into the at least one receiving area.

14. A squib electrical connector assembly as in claim 13 wherein the ramp portion of the second housing member comprises a top of the scoop proof dome.

15. A method of assembling a squib electrical connector comprising:

providing a first housing member;

connecting an electrical contact shorting member to a second housing member, wherein the second housing member comprises an elevated height scoop proof dome portion;

connecting electrical male contact terminals to the first housing member;

inserting the second housing member into the first housing member wherein the elevated height scoop proof dome portion extends above a top side of the first housing member; and electrically connecting the male contact terminals to each other by the electrical contact shorting member, wherein connecting the electrical contact shorting member to the second housing member comprises mounting the shorting member to a wall of the second housing member, wherein the wall separates two plug housing receiving areas from each other, and wherein a portion of the wall located above the shorting member forms a ramp adapted to move a portion of a mating plug electrical connector when the mating plug electrical connector is inserted into the two plug housing receiving areas.

16. A method as in claim 15 wherein inserting the second housing member into the first housing member comprises locating the male contact terminals in a plug receiving area of the second housing.

17. A socket electrical connector as in claim 1 wherein the first housing member comprises a keying slot on a top side and the second housing member comprises a keying section inserted into the keying slot.

18. A socket electrical connector as in claim 1 wherein the first housing member comprises offset keying slots on a top side and the second housing member comprises offset keying sections inserted into the keying slots.

19. A socket electrical connector as in claim 4 wherein the first housing member comprises a keying slot on a top side and the second housing member comprises a keying section inserted into the keying slot.

20. A socket electrical connector as in claim 4 wherein the first housing member comprises offset keying slots on a top side and the second housing member comprises offset keying sections inserted into the keying slots.

21. A squib electrical connector assembly comprising:

a plug electrical connector comprising a plug housing, female electrical contacts and at least one ferrite tube, wherein the at least one ferrite tube surrounds a male pin receiving section of at least one of the female electrical contacts; and a socket electrical connector having the plug electrical connector mounted therein, the socket electrical connector comprising a socket housing, male electrical contacts and a contact shorting member, wherein the socket housing comprises a first housing member and a second housing member, wherein the second housing member is located in the first housing member and forms a scoop proof dome having a height extending above a top side of the first housing member, wherein the second housing member forms at least one receiving area having a portion of the plug housing mounted therein, wherein the portion of the plug housing comprises an extended height plug portion to accommodate a height of the scoop proof dome, and wherein the at least one ferrite tube comprises an extended height which extends above the top side of the first housing member.

* * * * *